United States Patent [19]

Cherry

[11] 4,089,070

[45] May 16, 1978

[54] CONFORMING GRIP GLOVE

[76] Inventor: Kenneth F. Cherry, 1533 Eastgate, Toledo, Ohio 43614

[21] Appl. No.: 775,849

[22] Filed: Mar. 9, 1977

[51] Int. Cl.[2] ..... A41D 19/00

[52] U.S. Cl. ..... 2/161 A

[58] Field of Search ..... 2/164, 158, 159, 160, 2/161 R, 161 A, 163, 167; 264/222, 223

[56] References Cited

U.S. PATENT DOCUMENTS

| | | | |
|---|---|---|---|
| Re. 21,439 | 4/1940 | Link | 2/161 A |
| 3,065,472 | 11/1962 | Linnell | 2/161 A |
| 3,342,182 | 9/1967 | Charos | 2/164 X |
| 3,500,477 | 3/1970 | Meszavos | 2/161 R |
| 3,563,234 | 2/1971 | Umstead | 264/222 |
| 3,726,620 | 4/1973 | Morton | 264/222 |
| 3,863,271 | 2/1975 | Moroney | 2/161 A |

FOREIGN PATENT DOCUMENTS

| | | | |
|---|---|---|---|
| 1,000,606 | 10/1951 | France | 264/222 |
| 942,208 | 3/1956 | Germany | 2/164 |
| 885,182 | 12/1961 | United Kingdom | 2/164 |

*Primary Examiner*—Doris L. Troutman
*Attorney, Agent, or Firm*—Kenneth F. Cherry

[57] ABSTRACT

In the field of grip enhancing devices a glove having the thickness of its material varying in proportion to the voids between the hand and an object being held produces the effect of a custom grip. This glove is useful in areas where a conforming handle would be beneficial.

4 Claims, 1 Drawing Figure

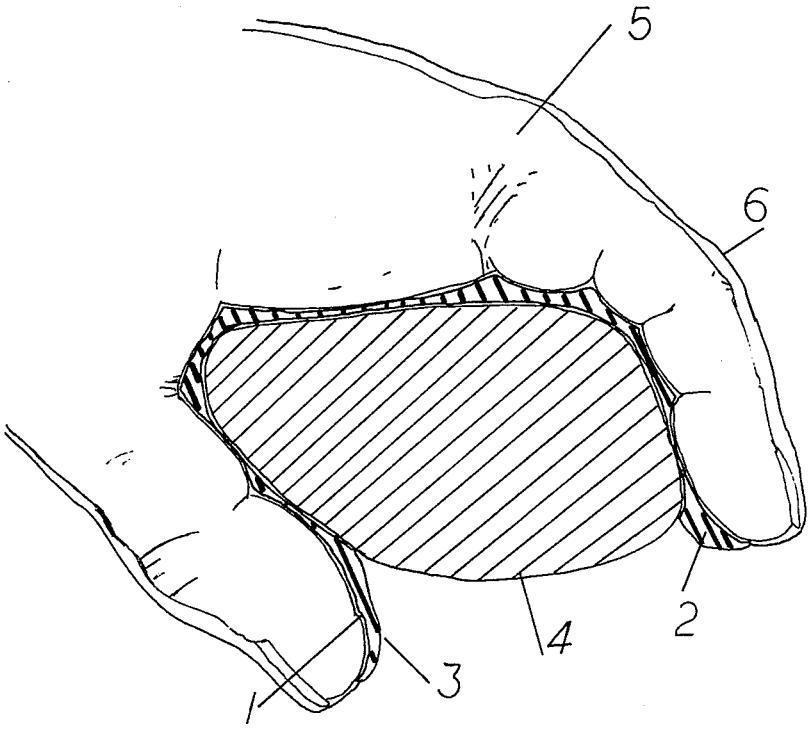
5
6
1
4
2
3
1

CONFORMING GRIP GLOVE

SUMMARY

Many tools and sporting devices are dependent upon the consistency of the relative position of the user's hands for most efficient use. Hand grips molded to the user's hand are one solution, however practical considerations often preclude their use. This invention overcomes many of the limitations of grips molded to a single user's hand while providing most of the advantages of such a grip as well as some new advantages. The use of a rigid or semi-rigid material molded in the form of a glove is the basic concept of this invention. This semirigid material is put between the hand of the user and the handle, then the proper position for the hand is assumed and the user tightens his grip on the handle. At this time the material which will form the semi-rigid contoured section between the user's hand and the handle is still a liquid or gell. As the user's hand tightens on the grip the liquid or gell fills the natural voids between the fingers and between the hand and the handle. This position is maintained until the material assumes is final formation and becomes set. A glove having two layers is the preferred holder for the semi-rigid material. In use one glove can be put on the hand and the other contains the proper amount of gel or liquid. The user then puts his hand with the glove on into the glove with the gel or liquid and then positions his hand on the handle of the tool or sport device. The glove thus serves as a convenient holder for the semi-rigid solid which is formed from the liquid or gel.

BRIEF DESCRIPTION OF DRAWINGS

The FIGURE is a section view of the invention showing (1) the inner membrane, (2) the conforming material, (3) the outer covering membrane (4) the grip or handle of a sport device, and (5) the person's hand with (6) glove.

DETAILED DESCRIPTION

In some sports as pistol target shooting and golf as well as in biomechanical design of tools to reduce some eregonomic stresses it is often of advantage to have a handle conform to the individual user's hand. In golf the exact placement of the hands relative to each other and the golf club has an effect on the accuracy of the player. If the players' grip can be made more consistent the overall performance will increase. In a similiar manner some tools are more efficient if a handle conforming to the operator's hand is provided. The present methods of producing handles to fit the ideal average persons are not adequate and it is often not cost effective to mold a handle to a user. One alternate solution is to mold a custom insert between a standarized handle and the user's hand. The material of the insert is best semi-rigid such as rubber semi-soft plastic or urathane foam. This type of material allows more comfort, however rigid materials as metal or plastic may be of some use in special instances.

Materials which are more or less liquid and then set or gel with time or some catalyst can be used. If the material proceeds from liquid to gel or set in relatively short times 1/2 minute to 10 minutes or so the user can have the material molded between his hand and the handle while he holds the handle, herein this type fluid is also referred to as conforming fluid. The fluid fills the voids between the hand and handle and conforms to any article which rests against the hand. When set the material provides an effect similiar to that obtained if the actual handle were molded to the users hand.

Since it is often necessary to remove the handle from the hand, in most instances a method of keeping the conforming material in place for repeated uses is desireable. The method of overcoming this problem, which is the basis of this invention, utilizes a unique glove or mitten. To produce this glove, a glove shaped membrane is first put on the user's hand. A second, slightly larger, or elastic membrane of similiar shape has put into it a quanity of the conforming fluid material previously discussed. The quantity of conforming fluid is dependent on the voids to be filled. In most instances for sport use or tools a few cubic centimeters is adequate. This second membrane is then put on the hand over the first membrane and the user holds the handle in the manner desired until the conforming material gells or sets. Should the conforming fluid set to fast the voids will not be filled, to slow and the person will become uncomfortable.

The material of the membrane should be chosen for the final use of the device. A soft leather outer membrane and similiar inner membrane is useful for golf or handgun uses. It may often be necessary to modify the membranes to restrict or eliminate conforming fluid from entering some areas. The trigger finger of a handgun glove may be void of fluid or elimated completely. Also for handgun use there is no need for the back of the hand to have conforming properties and this may be so constructed so as to reduce the amount of conforming material. In golf however, one hand is over the other and it may be desirable to have both front and back of the glove with conforming material. In most cases $\frac{1}{8}$ inch maximum thickness of conforming material is adequate however $\frac{1}{4}$ inch or more may occassionally be needed. The finished glove may also then be perforated to allow body moisture to escape and provide more comfort.

Plastic imitation leather gloves with two part urethane foam as the conforming material, the foam with a maximum thickness of approximately $\frac{1}{8}$ inch will allow the hand to be used for most necessary routine operations, as driving a golf cart, or loading a gun without removing the glove.

Several choices for the semi-rigid conforming material are available, catalyst set resin, or rigid and semi-rigid chemical foam, either mixed before or encapsulated are the primary choices. Choices for the membranes can be cloth, plastic, fiber, rubber, or other material chosen for a specific job. The gloves, when finished are used as any other glove except a "good feel" is obtained only when the hand is holding the handle in substantially the same way as when the conforming material set.

For the purposes of this patent gloves or mittens and ordinary modifications thereof are considered equivalent.

Most conforming materials will adhere to most membrane materials and this is a desirable result. The conforming material must be in essentially the same position relative to the user's hand every time the glove is used. With some conforming fluids the second membrane may be the surface of the set fluid and in this use it is understood to be included as one of the membranes as used herein. Also of use are gloves which are constructed of a single homogeneous material; this material when activated will act as the two membranes conforming fluid filled glove discussed herein. For example some urethane materials when exposed to the proper solvent or heat become soft and reset to their original texture as the solvent evaporates. If this type material is compressed the compressed sections will reset with less than their original volume. Some of the material may also be forced out into voids, and add to the volume or thickness of material in this area. For the purposes of this document the inner and outer surfaces are considered equivalent to the membranes discussed herein and the material between the surfaces is equivalent to the conforming material. Because of the large selection of synthetic and natural materials a comprehensive listing of suitable materials can not be made. Any person skilled in the art knowing the end use and the necessity of having a conforming material can easily select adequate materials. The use of a conforming material or liquid, gel or compressible solid is a matter of choice and all combinations with or without distinct separate membranes on one or both surfaces are to be considered equivalent for the purpose of the patent.

Having described the invention I claim:

1. An improvement in gloves comprising a hand grip enhancing device having in combination:

an outter membrane in the shape of a conventional glove an inner membrane in the shape of a conventional glove said inner membrane located inside said outter membrane a conforming material of varing thickness between said inner membrane and said outter membrane, the variable thickness of the conforming material being proportional to the void formed between the hand and a handle device, the proportional thickness of the conforming material resulting from curing of the conforming material while the device is worn on the hand and the hand is gripping a handle.

2. The invention of claim 1 wherein said conforming material is in preselected portions of said space therebetween.

3. The invention of claim 1 wherein said conforming material has a maximum thickness of less than 1/4 inch.

4. The invention of claim 1 wherein said inner membrane and said outter membrane and said conforming material are a single homogenious material.

* * * * *